United States Patent [19]

Hanson et al.

[11] 3,968,425

[45] July 6, 1976

[54] MEASURING IGNITION TIMING USING STARTER CURRENT

[75] Inventors: Richard Eric Hanson, Winchester; William Fulmer Fordyce, Arlington, both of Mass.

[73] Assignee: RCA Corporation, New York, N.Y.

[22] Filed: June 30, 1975

[21] Appl. No.: 591,951

[52] U.S. Cl. ..... 324/16 T

[51] Int. Cl.[2] ..... F02P 17/00

[58] Field of Search ..... 324/16 T; 73/117.2, 73/115, 116

[56] References Cited

UNITED STATES PATENTS

| | | | |
|---|---|---|---|
| 3,713,331 | 1/1973 | Peterson et al. | 73/117.2 |
| 3,765,233 | 10/1973 | Germann | 73/117.2 |
| 3,823,606 | 7/1974 | Maringer | 73/115 |

*Primary Examiner*—Stanley T. Krawczewicz
*Attorney, Agent, or Firm*—Edward J. Norton; Carl V. Olson

[57] ABSTRACT

Apparatus for and method of measuring the ignition timing of an internal combustion engine while cranking the engine with the starter motor, and with the ignition inhibited. Starter motor current fluctuations are examined to determine the times of current peaks due to compression in individual cylinders. Means coupled to the ignition circuit determines the times of points openings. A time difference signal representing the lead or lag of the ignition relative to the starter current peaks is generated. The lead or lag is then related to the time of top dead center in terms of degrees.

10 Claims, 14 Drawing Figures

MEASURING IGNITION TIMING USING STARTER CURRENT

The invention herein described was made in the course of or under a contract or subcontract thereunder with the Department of the Army.

BACKGROUND OF THE INVENTION

The testing of the timing of spark ignition in an internal combustion engine is normally accomplished by means of a mark on the engine flywheel or vibration damper which, when lined up with a reference mark, indicate the top dead center position of a piston in its cylinder. The mark on the rapidly rotating flywheel is observed by a stroboscopic light which is controlled by the engine ignition system. The test requires considerable skill, and is undesirably time consuming.

SUMMARY OF THE INVENTION

A very rapid and convenient determination of ignition timing is accomplished by comparing the times of the peaks of the starter motor current while cranking the engine with the ignition inhibited. The times of current peaks are compared with the times of ignition points opening. The times of current peaks have a known relation with times of top dead center, so that the lead or lag of ignition relative to top dead center in degrees can be derived.

DESCRIPTION OF FIG. 1 EMBODIMENT

Figure 1:
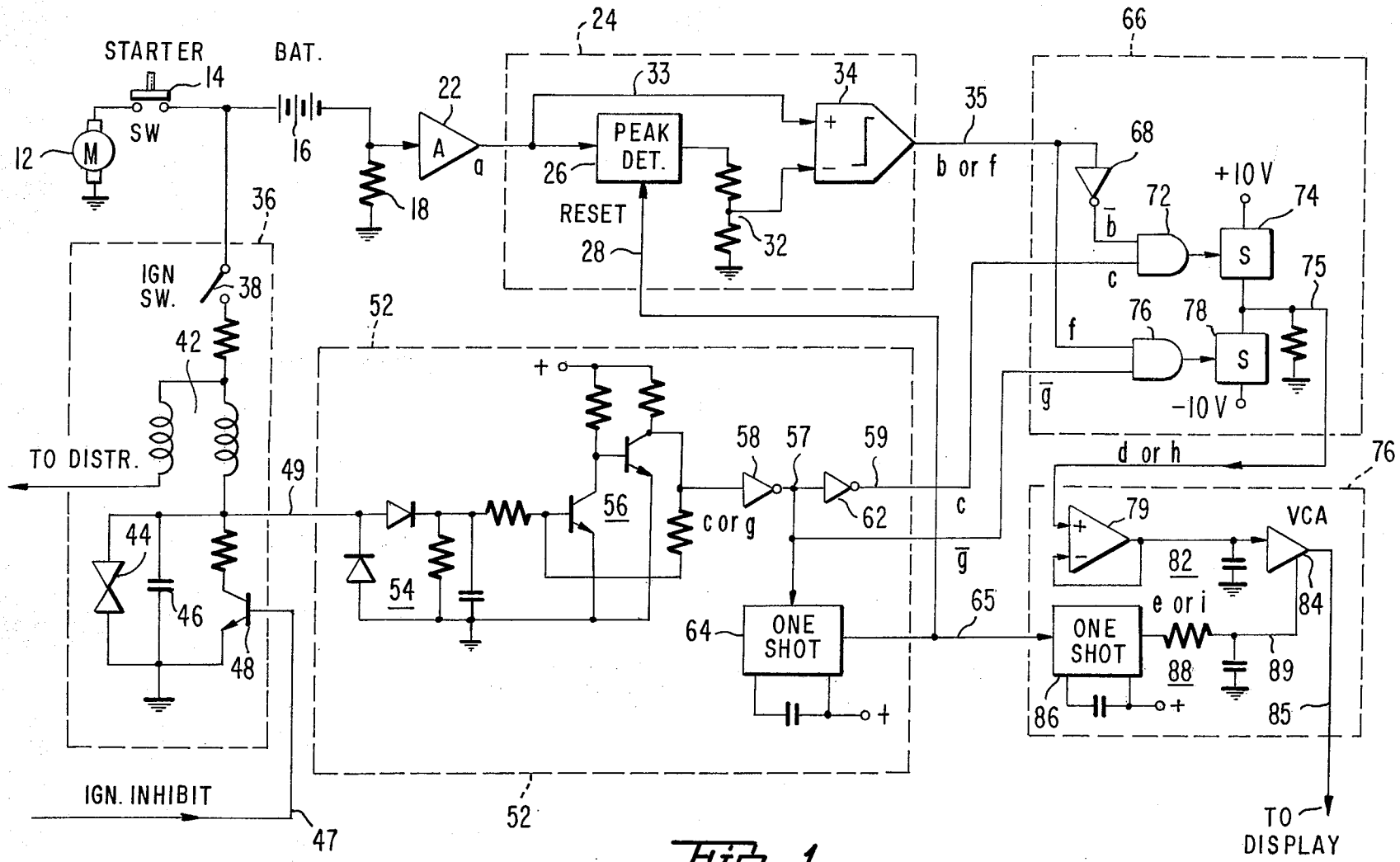
FIG. 1 is a diagram of hard wired electrical and electronic hardware for determining the timing of the spark ignition of an internal combustion engine.
Figure 2:
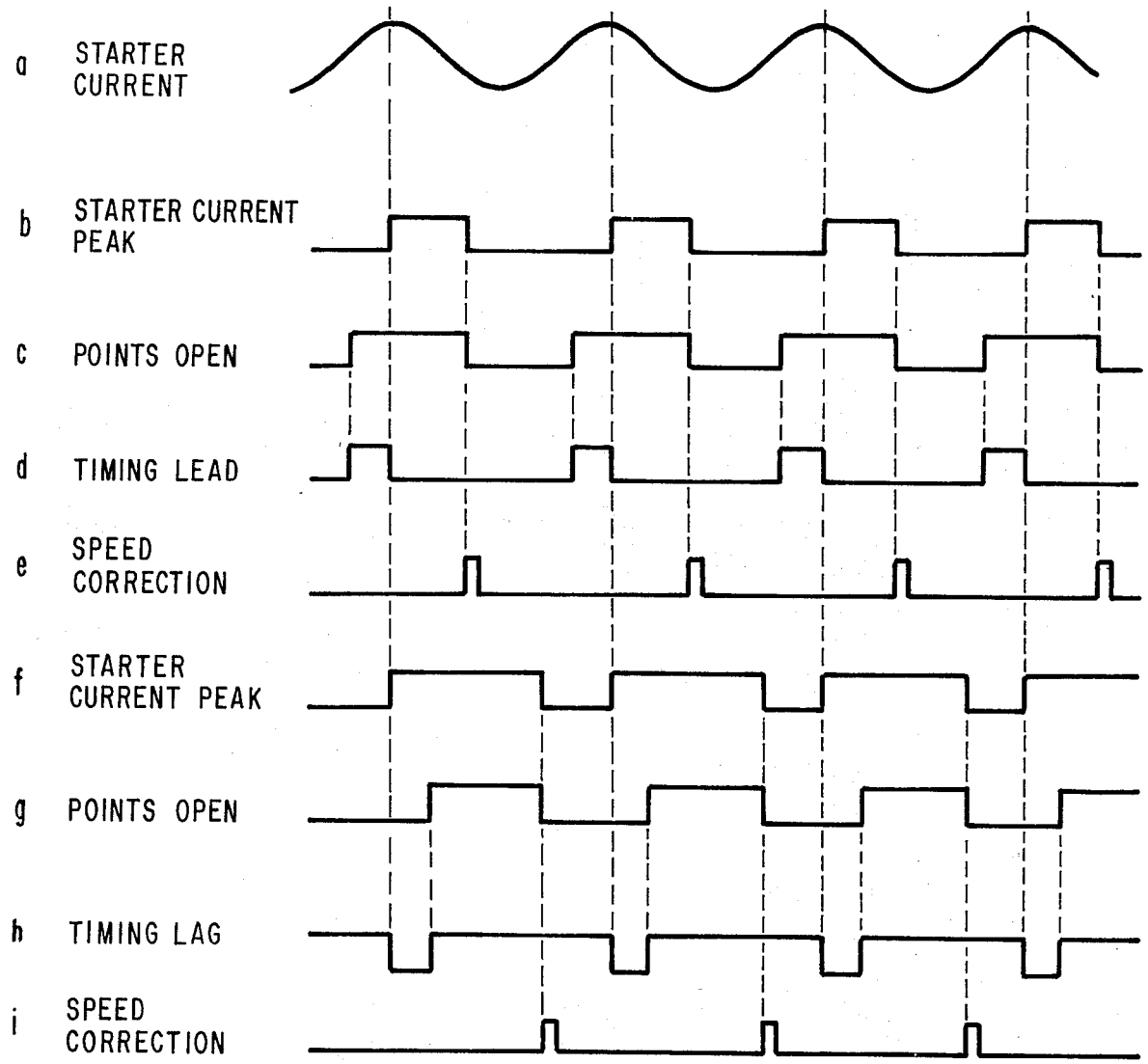
FIG. 2 is a chart of electrical waveforms which will be referred to in describing the operation of the apparatus of FIG. 1.

Reference is now made to FIGS. 1 and 2 for a description of apparatus for determining the time of spark ignition relative to top dead center (TDC) by observing the starter motor current waveform while cranking the engine with the ignition sparks inhibited. A starter motor 12 is supplied with electric current through a switch 14 from a battery 16. The current path includes a low value resistor 18 across which a voltage waveform, FIG. 2*a*, representative of the current to the starter motor is produced. The voltage waveform is amplified in a conventional operational amplifier 22 having filter means to favor frequency components of interest.

The amplified voltage waveform is applied to a first pulse wave generator 24 which generates starter current peak pulses, FIG. 2*b*, extending from each starter current peak to the following time of ignition points closing. Pulse wave generator 24 includes a conventional peak detector 26 which retains the highest amplitude of the starter current waveform applied to it until reset by a points closing signal applied over line 28. A portion of the output of the peak detector 26 is applied from a voltage divider 32 to the reference input of a conventional comparator 34. The comparator provides an output at 35 when the current waveform applied over line 33 exceeds the reference input. The output at 35 is as shown in FIGS. 2*b* and 2*f*.

Current from the battery 16 is also applied to a conventional spark ignition system 36 including an ignition ON-OFF switch 38, an ignition coil 42, a pair of ignition points 44 operated by a cam (not shown) and a capacitor 46 connected across the points 44. The high voltage energy normally supplied through coil 42 and the distributor (not shown) to the engine spark plugs may be inhibited by a signal applied over line 47 to control a transistor 48 connected in shunt with the points 44. However, regardless of whether or not the ignition is thus inhibited, a voltage waveform is present at 49 from which a second pulse wave generator 52 can generate pulses, FIGS. 2*c* or 2*g*, corresponding with the periods of time that the points 44 are open.

The second or points-open pulse wave generator 52 includes an input circuit 54 designed to filter out negative voltage spikes occurring when the ignition points initially open. A two-transistor circuit 56 is a conventional threshold amplifier and clipper which may produce zero volts output when the input signal is below 0.7 volts, and 5 volts output when the input signal is above 0.7 volts. The points 44 are open for about as long as they are closed, so that the output at 59 following inverter 62 is a square wave having substantially equal positive and negative half cycles, as shown by FIGS. 2*c* or 2*g*. A monostable multivibrator or one-shot 64 is triggered by the waveform at 57 to produce a short pulse on line 65 whenever the points 44 close. This short pulse acts over line 28 to reset the peak detector 26 already described.

A waveform comparator 66 compares the outputs of the first or current-peak and the second or points-open pulse wave generators 24 and 52, and provides a positive output pulse having a duration from the time that the points open until the time of the starter current peak, or, provides a negative output pulse having a duration from the time of the starter current peak until the time that the points open.

The starter current peak waveform 2*b* on lead 35 is inverted in inverter 68 and applied to one input of an "and" gate 72. The points open waveform 2*c* is applied to the other input of gate 72. When the two inputs are both positive, the gate 72 is enabled providing an output which closes switch 74 and connects the +10v. terminal to the output line 75. The signal on line 75 is then as shown by FIG. 2*d*.

The starter current peak waveform 2*f* on lead 35 is applied to one input of an "and" gate 76. The points open waveform 2*g* after inversion by inverter 58 is applied to the other input of the gate 76. When two inputs to the gate 76 are both positive, the gate is enabled providing an output which closes switch 78 and connects the −10v. terminal to the output line 75. The signal on line 75 is then as shown by FIG. 2*h*.

The output line 75 from comparator 66 is connected to one input of an integration and speed compensation circuit 76 including, in order, a unity gain voltage follower 78, an integrator 82 and a voltage controlled amplifier 84 having an output line 85. The integrator 82 smooths the pulse 2*d* or 2*h* into a voltage having a positive or a negative amplitude dependent on the duration of the respective pulses 2*d* or pulses 2*h*. Such signals can be applied to any suitable display device (not shown).

The circuit 76 also includes means to compensate the output signal on lead 85 for the effect on the timing of the starter current peak due to the speed at which the engine is being cranked by the starter motor. The speed compensation means includes a one-shot multivibrator 86 which receives short pulses from the one-shot multivibrator 64 at the times of points closings. The pulses, which have a repetition rate exactly proportional to engine speed, are smoothed in an integrator 88 to provide a voltage amplitude at 89 which is proportional to engine speed. This signal is applied to the control input terminal of the voltage controlled amplifier 82 to compensate the output signal at 85 in accordance with engine speed.

OPERATION OF FIG. 1

In the operation of the ignition timing tester of FIG. 1, the starter motor switch 14 is closed to supply battery current to the starter motor 12 and crank the engine. The ignition switch 38 is closed, but an ignition spark inhibiting signal is applied on lead 47 to prevent explosions of fuel in the cylinders of the engine. The starter motor current waveform developed across resistor 18 may be as shown by FIG. 2*a*. Circuit 24 translates the waveform to a rectangular wave 2*b* or 2*f* having pulses starting at the peaks of the starter current waveform and ending at the times of points closings. Circuit 52 produces a rectangular wave 2*c* or 2*g* having pulses starting when the points open and ending when the points close. The comparator circuit 66 compares the outputs from circuits 24 and 52 and produces a positive output pulse 2*d* having a duration corresponding with the lead time of the ignition relative to the starter motor current peak, or produces a negative output pulse 2*h* having a duration corresponding with the lag time of the ignition relative to the starter motor current peak. An integration and speed compensation circuit 76 translates the positive or negative pulses from circuit 66 to positive or negative voltages having amplitudes corresponding with the durations of the pulses.

The signals have amplitudes representing how much the spark timing leads or lags the starter motor current peaks. The starter motor current peaks occur at fixed times relative to the times that the pistons are at top dead center at a given speed of engine cranking. The time relationship varies with speed of cranking. Therefore the signals are modified or compensated in accordance with the actual cranking speed so that the signals represent how much the spark timing leads or lags the times that the pistons are at top dead center. A speed correction signal provided by one-shot 86 and integrator 88 is used to control the voltage-controlled amplifier 84. The corrected or speed-signals compensate from amplifier 82 are then applied to a display device, such as a voltmeter calibrated to show the measured spark timing in degrees before or after top dead center.

DESCRIPTION OF FIG. 3 EMBODIMENT

Figure 3:
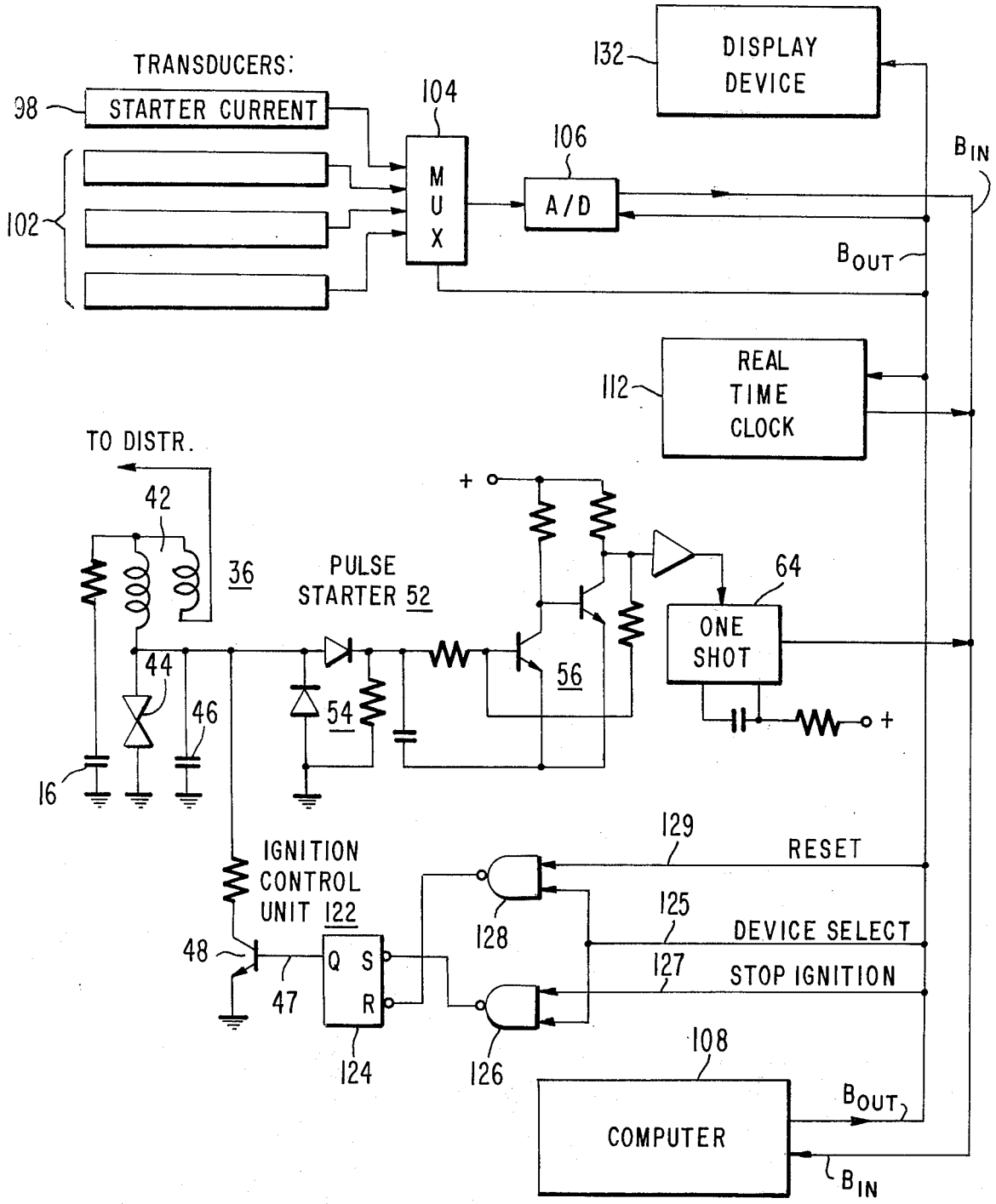
FIG. 3 is a diagram of an alternative apparatus, including a computer, for determining the timing of the spark ignition of an internal combustion engine.

FIG. 3 shows an alternative apparatus for determining the time of spark ignition relative to top dead center by observing the starter motor current waveform while cranking the engine with the ignition sparks inhibited. Ignition system parts are given the same numerals as corresponding parts have in FIG. 1. A starter current transducer 98 has its output connected together with the outputs of other transducers 102 to a multiplexer, from which the signals are applied in time-shared sampling fashion to an analog-to-digital converter 106. The resulting digital signals are transferred over bus $B_{in}$ to a general purpose minicomputer 108. The converter 106 is controlled in its operation by control signals from computer 108 over bus $B_{out}$.

The computer 108 may, by way of example only, by a "Nova 1200" minicomputer manufactured and sold by Data General Corporation, Southboro, Mass., Zip 01772. The Nova 1200 is a low cost minicomputer designed for general purpose applications. It has a 16-bit word, multi-accumulator central processor, and a full memory cycle time of 1200 nanoseconds. It executes arithmetic and logical instructions in 1350 nanoseconds. The entire Nova 1200 central processor fits on a single 15-inch-square printed circuit subassembly board. The basic computer includes four thousand 16-bit words of core memory, a Teletype interface, programmed data transfer, automatic interrupt source identification, and a direct memory access channel. User programming conveniently can be in the BASIC language.

A Real Time Clock 112 may be a standard option available with the Nova 1200 computer, and the A/D converter 106 and multiplexer 104 may be one of the standard Nova peripherals such as the 4141/CPU eight channel, 12-bit analog to digital conversion system.

A pulse shaper 52, like the one in FIG. 1, responds to the ignition system 36 and supplies an interrupt pulse from one-shot 64 through bus $B_{in}$ to the computer 108 every time the ignition distributor points 44 open.

An ignition control unit 122 includes a flip-flop 124 from which an output on line 47 can render transistor 48 conductive and thus prevent the sending of spark pulses from ignition system 36 to the spark plugs when the distributor points 44 open. The flip-flop 124 is set by an output from a gate 126 when it is enabled by a "device select" signal on line 125, and a "stop ignition" signal on line 127 from the computer 108. The flip-flop 124 is reset by an output from a gate 128 when enabled by a "reset" signal over line 129 from computer 108.

The test results computed by the computer 108 are displayed by a display device 132 which may be a conventional Teletypewriter, a printer, a 4-digit display such as one including Numitron character display tubes, or any other suitable display device.

Figure 4A:
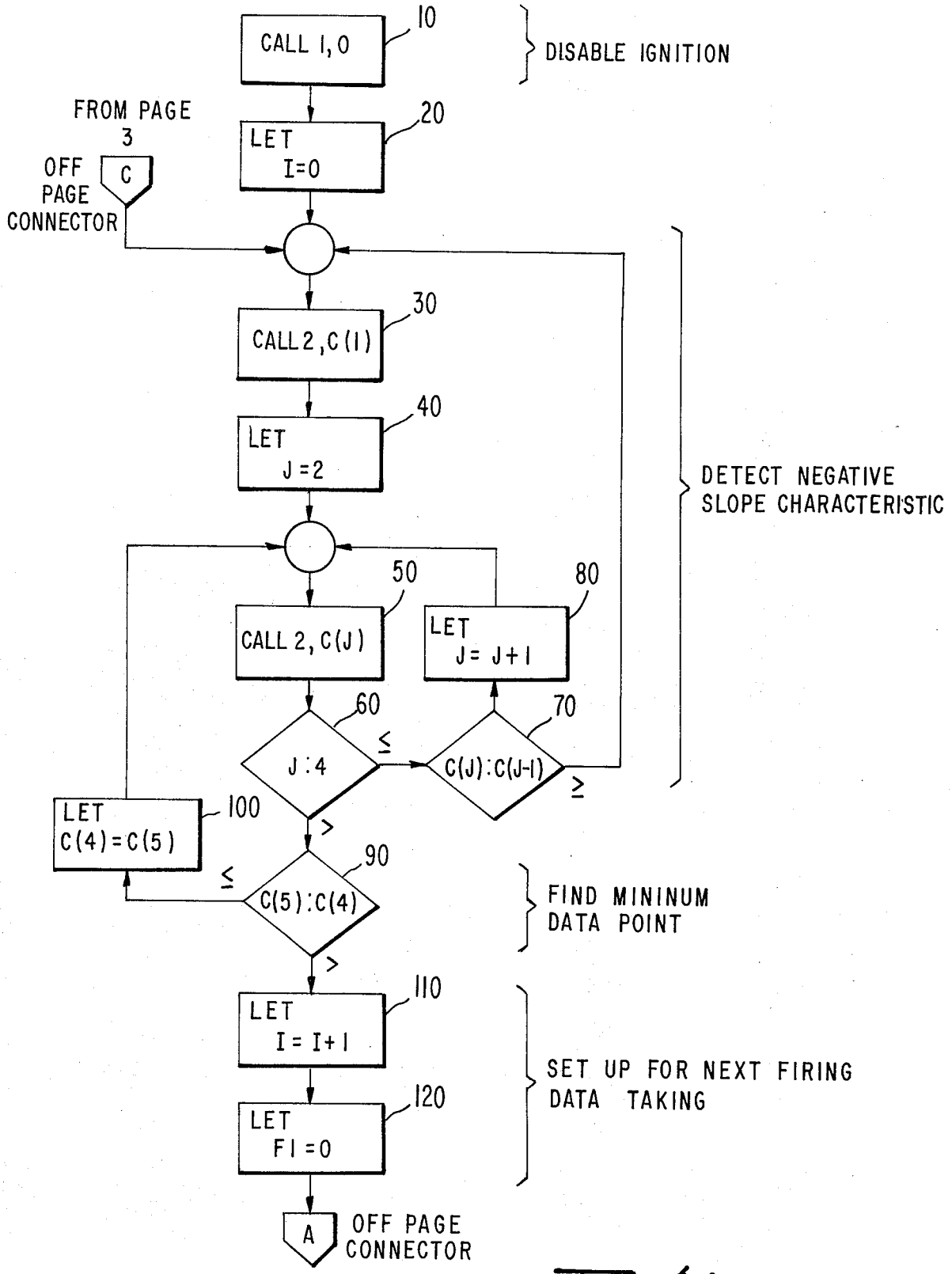
FIGS. 4A, 4B and 4C are flow charts of a computer program used in the computer to control the operation of the computer and other apparatus of FIG. 3.
Figure 4B:
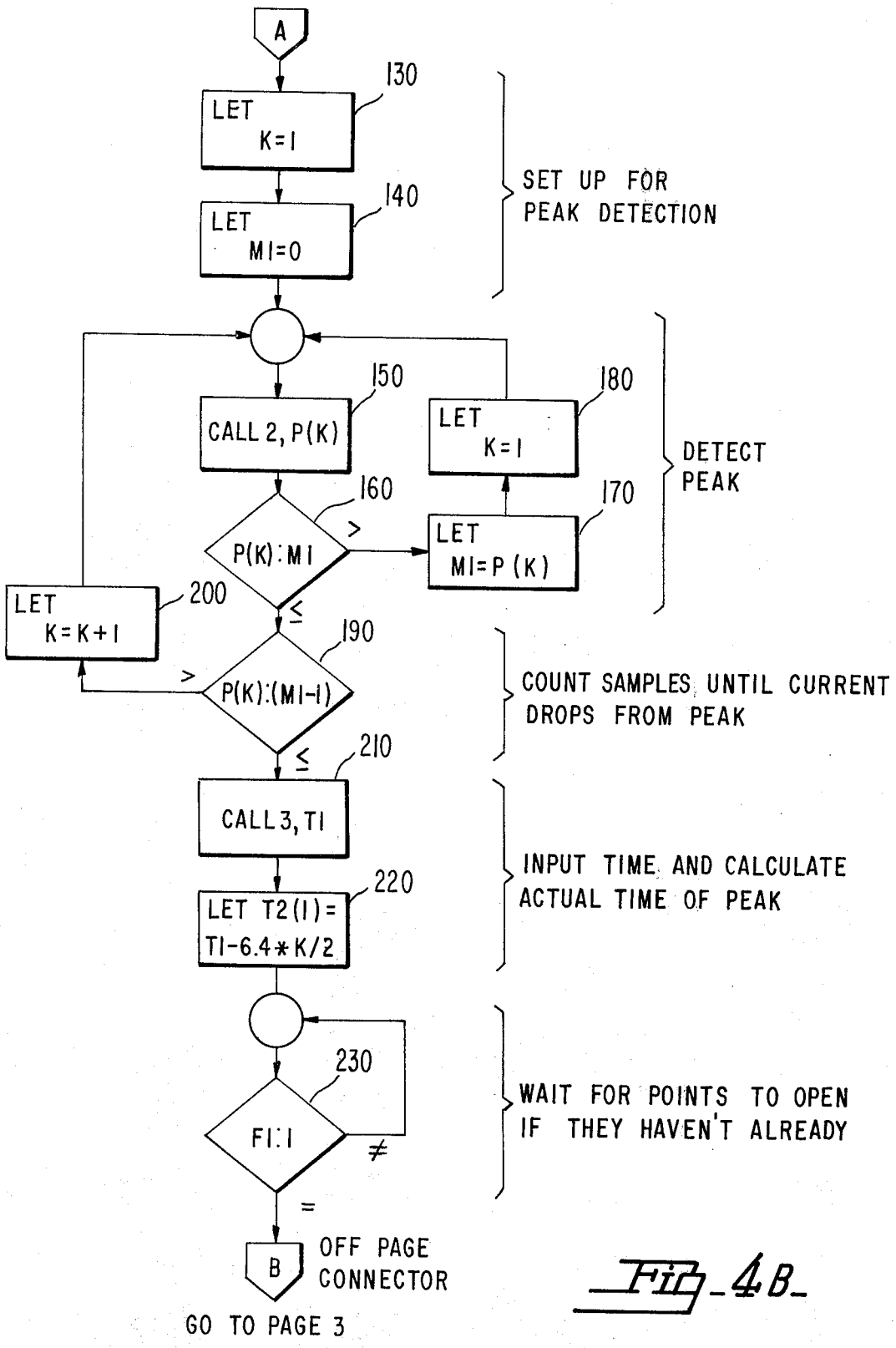
Figure 4C:
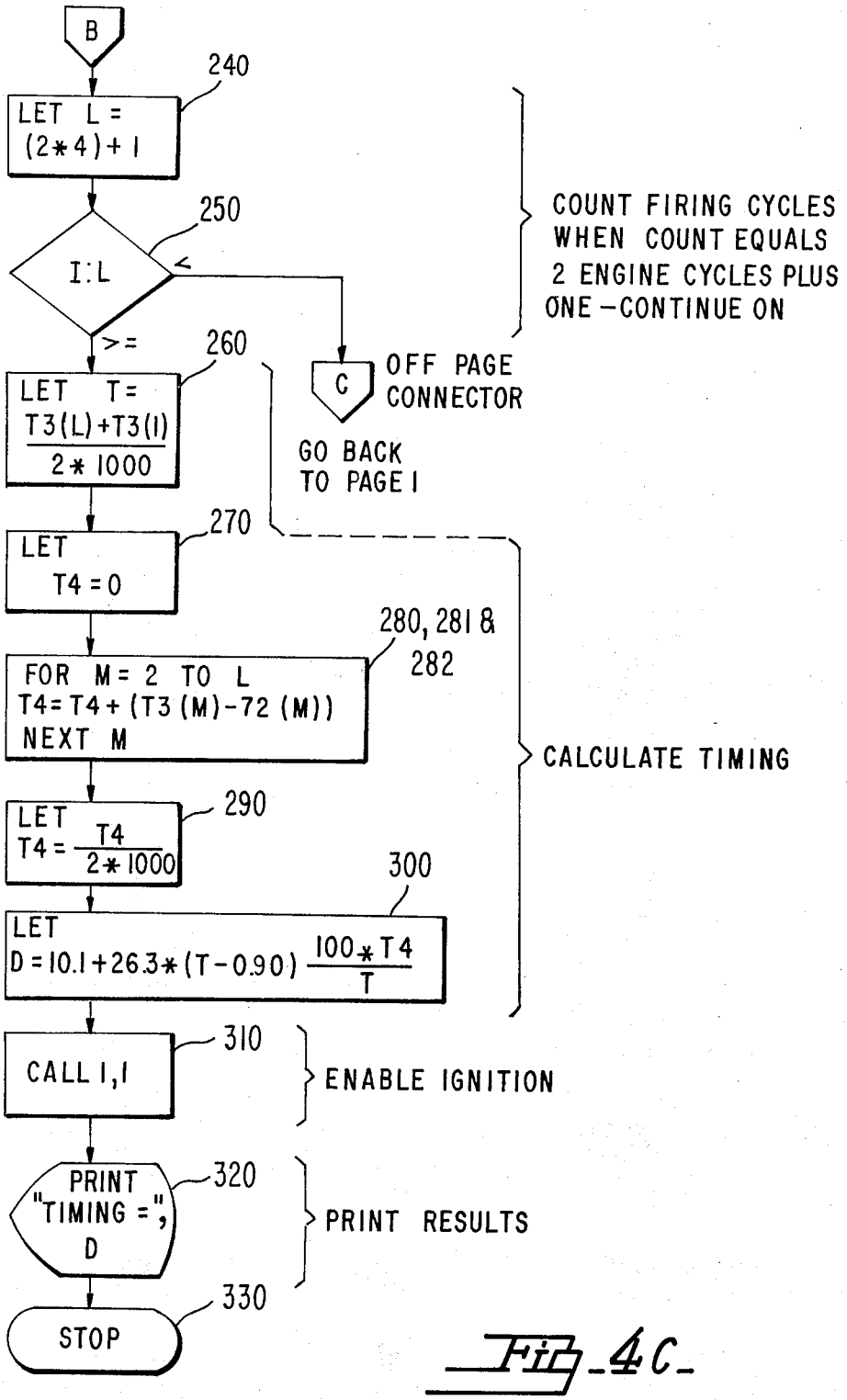

The apparatus shown in FIG. 3 is used for testing the ignition timing of an engine, and it is also useful concurrently or sequentially for making other engine performance tests. The operation of the system is controlled by the computer and by the program stored in the computer. The portion of the computer program concerned with the testing of ignition timing will be described with references to the flow charts of FIGS. 4A, 4B, and 4C.

OPERATION OF FIG. 3

In the operation of FIG. 3, the engine (not shown) is cranked by the starter motor with the ignition switch "on". The computer 108 supplies signals to the ignition control unit 122 which prevent the spark plugs of the engine from firing, while permitting the pulse shaper 52 to respond to the ignition system and send a pulse to the computer every time the points 44 open.

The computer receives frequent samples of the starter current amplitude from starter current transducer 98 through multiplexer 104 and A/D converter 106. The computer continuously compares the starter current sample amplitudes and determines the time at which a peak amplitude occurs. The computer computes the time interval between the current peak and the points opening.

The computer computes the time displacement of the starter current peak relative to the piston top dead center at the particular measured cranking speed of the engine. The computer thus determines the lead or lag of the ignition in relative to top dead center.

The computer also makes the non-linear translation from ignition lead or lag in time to ignition lead or lag in angular degrees relative to top dead center. The calculated ignition lead or lag in degrees relative to top dead center is then displayed by display device 132.

FLOW CHART OF FIG. 4

A detailed description of the operation of the apparatus of FIG. 3 is given with references to the program flow chart of FIG. 4. See also the Appendix for subroutines and program variables.

It is assumed that the engine is already cranking and the ignition is turned on prior to starting this test. Under these conditions the program depicted in FIG. 4 will control the test operation. A detailed explanation of each part of this program is given below. Because of the special nature of the Interrupt Program, this part of the program is discussed first.

An interrupt input to a computer is a special input. When a pulse occurs on such a line it allows the computer to finish the instruction which it is executing and then causes it to jump to another location of memory and start executing a special program located there. This type of input is used in this device where the output of Pulse Shaper (52) gives an interrupt to the computer causing it to jump to the special Interrupt Program which simply does three things as shown below:

Interrupt Program

| Statement Number | Statement and Description |
|---|---|
| 1010 | CALL 3, T3(I). As indicated in the subroutine descriptions, this statement simply inputs a real time value and saves it as T3(I) where I is controlled in the main program. |
| 1020 | LET F1 = 1. This instruction sets the flag variable F1 equal to 1 to indicate to the main program that an interrupt has occurred (points have opened). |
| 1030 | RETURN. This instruction simply defines the end of the interrupt program. This causes the computer to resume operation wherever it left off in the main program. |

Thus, this part of the program causes the system to automatically record the time each time the ignition points open. Where the data is stored is controlled by the main program since the variable I (which points to a specific T3 array location) is set only by the main program.

Main Program

| Statement Number | Statement and Description |
|---|---|
| 10 | CALL 1, 0. As indicated in the subroutine descriptions this statement inhibits the ignition from firing. This prevents a firing or partial firing of the engine from distorting the starter current waveform. Functionally, the ignition is inhibited by causing the computer to output both a Stop Ignition and a Device Select signal to the Ignition Control Unit (see FIG. 3) which sets flip-flop 124 and turns on transistor 48 until flip-flop 124 is reset by a CALL 1, 1 instruction. |
| 20 | LET I = 0. This instruction simply initializes the firing cycle counter, I, to zero. |
| NOTE: | The next part of the program (instructions 30–100) synchronizes the test system with the starter current variations and essentially sets the system up for taking timing data on the first or next points opening relative to Top Dead Center. It does this by first detecting a continuing negative slope characteristic and then by detecting the waveform minimum value. |
| 30 | CALL 2, C(1). As indicated in the subroutine descriptions this statement measures an average value of starter current (averaging filters out starter commutation ripple) and saves the value as C(1). |
| 40 | LET J = 2. This instruction sets the counting variable to 2 so that the next instruction will store its measured value as the second point in the C array. |
| 50 | CALL 2, C(J). As indicated in the subroutine descriptions this statement measures an average value of starter current and saves the value as C(J). |
| 60 | IF J > 4 then GO TO 90. This statement compares the value of the counting variable J to 4 and if it is larger the computer will next execute instruction 90. Otherwise it will execute the next sequential instruction, 70. For J to be greater than 4 the system must have found 4 sequential decreasing average values for starter current (see instructions 70–85). |
| 70 | If C(J) >= C(J − 1) THEN GO TO 30. This is the instruction which actually checks the waveform slope characteristic. It causes the computer to compare the last two average measurements and if the last is not the smallest (i.e. it is greater than or equal to the previous measurement) the computer jumps back to instruction 30 and starts taking negative slope data all over again. |
| 80 | LET J = J + 1. |
| 85 | GO TO 50. When the last two measured values were found to have a negative slope characteristic by instruction 70, these instructions cause the computer to increment the value of J and jump back to instruction 50 to take the next measurement. Thus, when a negative slope characteristic is found the computer will loop in instrutions 50 through 85 until four sequential decreasing values are measured. |
| 90 | If C(5) > C(4) THEN GO TO 110. When the computer gets to this instruction it has already measured four sequential decreasing values of starter current, set J equal to 5, and measured a fifth value C(5). The purpose of this instruction is to find the minimum point for this cycle of the waveform so this instruction causes the computer to compare the last two measured values. If the last value, C(5), is the largest, then the system continues on to instruction 110 since it knows that the minimum point has passed. Otherwise it executes the next sequential instruction, 100, and continues looking for the minimum value. |
| 100 | LET C(4) = C(5). |
| 105 | GO TO 50. At this point in the system operation the computer has not yet detected a minimum point so instruction 100 causes it to save the last measured value, C(5), as C(4) and instruction 105 causes it to branch back to instruction 50 to measure a new C(5) value. |
| NOTE: | At this point in the system operation the starter current has just passed a minimum value so the system now has to set up for the first or next time of peak and time of points opening measurement. Instructions 110–140 simply set up for these tasks. |
| 110 | LET I = I + 1. This instruction simply increments the firing cycle counter by one since the system is setting up to take data on a new firing cycle. |
| 120 | LET F1 = 0. This instruction sets the |

-continued

Main Program points opening flag, F1, to zero. When the points open this flag is set to one by the interrupt program automatically.

130 LET K = 1. Execution of this instruction simply initializes the peak value data counter to a value of one.

140 LET M1 = 0. Execution of this instruction simply initializes the peak detector parameter M1 to zero (see Program Variable descriptions in Appendix B.)

150 CALL 2, P(K). As indicated in the subroutine descriptions execution of this instruction causes the system to make an average measurement of the starter current and to store it as a P(K).

160 IF P(K) < = M1 THEN GO TO 190. This instruction is the key peak detection instruction. If the newest measurement, P(K), is not greater than the peak detector parameter M1, then a peak must have been reached so the system jumps forward to instruction 190. Otherwise it executes the next sequential instructions (170, 180, 185) and sets up for a new measurement and peak test.

170 LET M1 = P(K). This instruction simply saves the highest value measured so far in this firing cycle (the last measurement) as M1 for peak detection by comparison with future P(K) measurements.

180 LET K = 1.

185 GO TO 150. Since a true peak has not been detected yet, these instructions simply insure that the peak sample counter, K, is set equal to one and send the computer back to instruction 150 to take another measurement.

190 IF P(K) <= (M1 − 1) THEN GO TO 210. This instruction is testing for the end of a peak. For the purpose of this apparatus the end of a peak is when an average measurement value drops one amp below the peak detected value, M1. Thus, this instruction compares the last measured P(K) value with (M1 − 1) and if it is less than or equal to this end of peak limit the computer branches to instruction 210. Otherwise it executes the next sequential instructions 200 and 205.

200 LET K = K + 1.

205 GO TO 150. These two instructions simply increment the peak measurement counting variable K and cause the computer to branch back to instruction 150. This causes the system to take another P(K) measurement and to check if it too is part of the peak.

210 CALL 3, T1. As indicated in the subroutine descriptions execution of this instruction inputs a real time clock value (units of msec) and saves it as T1.

At this point in the program the system has all of the information required to determine the time of the starter current peak. The peak is assumed to be in the center of the samples which where taken as peak samples, and one extra sample was taken after the peak (to determine that the peak was over). Knowing these facts the assumed time of peak is given by:

$$T_p = T1 - 6.4 - \frac{K}{2}(6.4)$$

220 LET T2 (I) = T1 − 6.4 − 6.4 * K/2. This instruction simply causes the computer to calculate the assumed time of an individual peak and to save that value in the T2 array location corresponding to the particular firing cycle under examination.

230 IF F1 >< 1 THEN GO TO 230. F1 is set to zero by the main program and reset to 1 by the interrupt program whenever the points open. This instruction simply tests for points opening. If the points have already opened F1 = 1 and the computer continues on. If the engine timing is significantly retarded and the points have not opened by the time that this instruction is first executed, then the computer will continually execute this instruction until F1 is set to 1 by the points opening interrupt program (i.e. it will wait for the points to open and then continue on).

240 LET L = (2 * 4) + 1. This instruction simply sets the firing cycle counter limit to (2 engine cycles) × (4 firings per engine cycle) + (one extra firing cycle). This limit is the minimum number of data cycles which will yield complete data on 2 full engine cycles.

250 IF I < L THEN GO TO 30. This instruction simply compares the firing cycle counter I to its limit L and causes the computer to branch back to statement 30 if data taking is not complete. If data taking is complete (I = L) the computer continues on to instruction 260.

260 LET T = (T3(L) − T3(1))/(2 * 1000). An equation for calculating engine timing is $D = 10.1 + 26.3(T - 0.90) - 100\, t_i/T$, where T = time in seconds for 1 full engine cycle (i.e. 2 crankshaft revolutions). The T calculated by the instruction above is the same T where T3(L) − T3(1) is the time for 2 full engine cycles in msec so this value is divided by 2 and 1000 to convert to 1 engine cycle and seconds.

270 LET T4 = 0.

280 FOR M = 2 TO L.

281 LET T4 = T4 + (T3(M) − T2(M)).

282 NEXT M.

290 LET T4 = T4/(2 * 1000). In the timing equation, $t_i$ = the sum of time in seconds between $I_{MAX}$ and points opening for 4 consecutive cylinders (1 engine cycle).

In the system operation T4 is equal to the $t_i$ described above. T4 is calculated by the 5 instructions above where (T3(M) − T2(M)) of instruction 281 is the actual time between the points opening and starter current peak for the Mth firing cycle. Instruction 270 initializes T4 to zero and then 280–282 form a loop which accumulates 2 engine cycles of time differences. The T4 resulting from this loop is then divided by 2 and 1000 to convert this to data for 1 engine cycle in seconds (instead of msec).

300 LET D = 10.1 + 26.3 * (T − 0.90) − 100 * T4/T This instruction causes the computer to calculate the actual engine timing in degrees before top dead center during cranking.

310 CALL 1, 1. As indicated in the subroutine descriptions this instruction just enables ignition firings so that the engine can start. This is done by having the computer output both a Reset and Device Select pulse to flip-flop 124 (see FIG. 3) simultaneously.

320 PRINT "TIMING = ", D. This instruction simply causes the computer to output the results to the Display Device (42). If the display device happens to be a teletype or printer it will also print "TIMING = " as well as the actual timing in degrees BTDC.

330 STOP. This instruction just stops the system ending the test.

Appendix A — Subroutines

CALL 1, A This subroutine either enables or inhibits the igniton. To run this test the igniton must be turned on so that the time of points opening can be determined and must be inhibited so that engine firings do not distort the normal cranking waveform. The value of parameter A determines which function is performed. If A = 0 this subroutine will inhibit all ignition firings until inhibit is reset by calling this routine again with A = 1 (or anything other than 0).

CALL 2, B This subroutine inputs 80 data samples from starter current channel through the multiplexor and the A/D converter with 80 μsec between samples. It then averages these samples and returns the average value to the main program as the parameter B (note that this should take 80 × 80 μsec or 6.4 msec).

CALL 3, C This subroutine inputs a number from the real time clock and stores this value as the parameter C. For the system being described the clock is running at 1 kHz meaning that the clock is effectively counting milliseconds.

Appendix B — Program Variables

Measured

C(J) is an array of average measurements of the starter current waveform. These measurements are used for detection of the negative slope characteristic and the actual -continued

| Main Program | |
|---|---|
| | minimum data point for each firing cycle. |
| P(K) | is similar to C(J) except that it is used for detecting the starter current peak value. |
| T1 | is a real time clock measurement. After the test system determines that the starter current peak is past T1 is input and saved for use in calculating the effective time of starter current peak. |
| T3(I) | is an array of real time clock measurements made each time the points open during the test (measured by the interrupt part of the program). |
| Calculated | |
| M1 | is a variable used for detection of the starter current peak. Once peak detection has started M1 is compared with each measured P(K) value and if it is less than the measured value then it is set equal to it so that eventually it is equal to the maximum measured value (for each peak). |
| T2(I) | is an array of values assumed to be the actual times (in msec) of the peaks as calculated by subtracting off one half of the sampling time for the peak values samples. |
| T | is the average time in seconds for one full engine cycle during the test as calculated by taking the time required for two full engine cycles and dividing by two. |
| T4 | is the average sum of time in seconds between maximum starter current and points opening for 4 consecutive cylinders. |
| D | is the actual timing of the ignition during cranking in degrees BTDC. |
| Counting and Flags | |
| I | counts engine firing cycles. |
| J | counts average data points used for negative slope detection on starter current waveform. |
| K | counts average data points within 1 amp of peak starter current after peak detected. |
| F1 | is reset before starting data taking corresponding to each cylinder firing and is set by the points opening interrupt routine. |

What is claimed is:

1. Apparatus for measuring the ignition timing of an internal combustion engine while cranking the engine with the starter motor, comprising means coupled to the starter motor circuit to derive a waveform representing starter motor current fluctuations having peaks due to compression in individual cylinders, means to generate from said waveform a current peaks signal indicating the times of current peaks, means coupled to the ignition circuit to generate a points openings signal indicating the times of points openings, and means to compare said signals to obtain a time difference signal representing the lead or lag of the ignition relative to the starter current peaks, which are displaced known amounts at given cranking speeds from times of top dead center.

2. Apparatus as defined in claim 1, and means to compensate one of said signals for the actual cranking speed during the test, whereby the ignition lead or lag time is indicated relative to top dead center.

3. Apparatus as defined in claim 2 wherein said current peaks signal is compensated in response to a cranking speed signal derived from said points openings signal.

4. Apparatus as defined in claim 2, and means to translate said time difference signal representing time of ignition relative to top dead center to a signal representing degrees of rotation between ignition and top dead center.

5. Apparatus as defined in claim 4 wherein said means to translate from a signal representing time to a signal representing degrees operates in a nonlinear fashion in accordance with speed changes occurring during each compressions stroke of the engine.

6. The method of measuring the ignition timing of an internal combustion engine while cranking the engine with the starter motor, comprising the steps of deriving a waveform representing starter motor current fluctuations having peaks due to compression in individual cylinders, generating from said waveform a current peaks signal indicating the times of current peaks, generating a points openings signal indicating the times of points openings, and comparing said signals to obtain a time difference signal representing the lead or lag of the ignition relative to the starter current peaks, which are displaced known amounts at given cranking speeds from times of top dead center.

7. The method as defined in claim 6, and the step of compensating one of said signals for the actual cranking speed during the test, whereby the ignition lead or lag time is indicated relative to top dead center.

8. The method as defined in claim 7 wherein said signal which is compensated is said current peaks signal which is compensated in response to a cranking speed signal derived from said points openings signal.

9. The method as defined in claim 7, and translating said time difference signal representing time of ignition relative to top dead center to a signal representing degrees of rotation between ignition and top dead center.

10. The method as defined in claim 9 wherein said translating from a signal repesenting time to a signal representing degrees operates is done in a nonlinear fashion in accordance with speed changes occurring during each compression stroke of the engine.

* * * * *